US010882706B2

(12) United States Patent
Jariabka et al.

(10) Patent No.: US 10,882,706 B2
(45) Date of Patent: Jan. 5, 2021

(54) PHOTO CASSETTE FOR A MOBILE PRINTER

(71) Applicant: Hewlett-Packard Development Company, L.P., Houston, TX (US)

(72) Inventors: Keith Jariabka, Vancouver, WA (US); Juan D Ramos, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/748,835

(22) PCT Filed: Oct. 30, 2015

(86) PCT No.: PCT/US2015/058481
§ 371 (c)(1),
(2) Date: Jan. 30, 2018

(87) PCT Pub. No.: WO2017/074465
PCT Pub. Date: May 4, 2017

(65) Prior Publication Data

US 2018/0222211 A1 Aug. 9, 2018

(51) Int. Cl.
*B65H 3/02* (2006.01)
*B41J 13/12* (2006.01)
(Continued)

(52) U.S. Cl.
CPC ..... *B65H 3/02* (2013.01); *B41J 3/36* (2013.01); *B41J 13/10* (2013.01); *B41J 13/103* (2013.01);
(Continued)

(58) Field of Classification Search
CPC ..... B65H 3/02; B65H 29/10; B65H 29/46; B65H 2301/41; B65H 3/5246; B65H 2405/21; B65H 3/52
See application file for complete search history.

(56) References Cited

U.S. PATENT DOCUMENTS 3,195,886 A * 7/1965 Houver ..... B43M 13/00 271/42
3,727,823 A * 4/1973 Sullivan ..... B65D 5/38 206/215
(Continued)

FOREIGN PATENT DOCUMENTS

EP 0497571 4/1997
JP 60132843 A * 7/1985 ..... B65H 3/02
(Continued)

OTHER PUBLICATIONS

HP Color LaserJet CP3525 Series Printer Service Manuel, CPAGlobal Patentability Search Report, Sep. 21, 2015, < ftp://ftp.hp.com/pub/softlib/software10/COL28608/rp-75064-1/HP_Color_LaserJet_CP3525_Service_Manual.pdf >, 564 pages.

*Primary Examiner* — Howard J Sanders
(74) *Attorney, Agent, or Firm* — Dicke Billig & Czaja PLLC

(57) ABSTRACT

In one example, a photo cassette for a mobile printer includes a support surface to support a stack of photo media sheets, a cover to at least partially cover the stack of photo media sheets, and a window formed in the cover to receive a pinch mechanism of the mobile printer through the window to provide a normal force to the stack of photo media sheets.

9 Claims, 6 Drawing Sheets

(51) Int. Cl.

| | |
|---|---|
| ***B41J 13/10*** | (2006.01) |
| ***B65H 1/04*** | (2006.01) |
| ***B65H 1/26*** | (2006.01) |
| ***B41J 3/36*** | (2006.01) |

(52) U.S. Cl.
CPC ..... *B41J 13/12* (2013.01); *B65H 1/04* (2013.01); *B65H 1/266* (2013.01); *B65H 2403/41* (2013.01); *B65H 2405/21* (2013.01)

(56) References Cited

U.S. PATENT DOCUMENTS

| | | | | |
|---|---|---|---|---|
| 6,375,314 | B1 | 4/2002 | Reed et al. | |
| 6,474,884 | B2 | 11/2002 | Chiu | |
| 6,975,831 | B2 | 12/2005 | Kumadaki et al. | |
| 7,600,746 | B2 | 10/2009 | Chino | |
| 8,220,795 | B2 | 7/2012 | Wong et al. | |
| 8,720,887 | B2 | 5/2014 | Metsuno et al. | |
| 8,727,334 | B2 | 5/2014 | Nunokawa et al. | |
| 2003/0214094 | A1* | 11/2003 | Eskey ..... | B65H 3/44 271/9.07 |
| 2005/0006835 | A1 | 1/2005 | Teo et al. | |
| 2005/0242492 | A1 | 11/2005 | Yang | |
| 2008/0296831 | A1* | 12/2008 | Chino ..... | B65H 1/04 271/145 |
| 2011/0262204 | A1 | 10/2011 | Miranda et al. | |
| 2012/0161381 | A1 | 6/2012 | Nakamura et al. | |
| 2015/0258816 | A1 | 9/2015 | Yoda et al. | |

FOREIGN PATENT DOCUMENTS

| | | | | |
|---|---|---|---|---|
| JP | 09132333 | A | * | 5/1997 |
| JP | 2004315196 | | | 11/2004 |

* cited by examiner

PHOTO CASSETTE FOR A MOBILE PRINTER

BACKGROUND

An alternate photo tray has become a feature for some consumer and office printers. It allows a common choice of media to be available for the occasional job without forcing customers to unload their most basic media choice like plain paper.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

One example is directed to a removable, small, 4×6 inch photo cassette accessory and driving mechanism for small, top-in, front-out mobile printers. A photo cassette is a useful feature for printers to have as it allows customers to load photo media without a main tray media load change for the occasional photo print job. One example is directed to a photo cassette accessory for a mobile printer platform that is minimal in size. Easy top installation of the photo cassette into the mobile printer makes it convenient for the customer to load both media in the main input tray, and media in the photo cassette.

The photo cassette pick system according to one example is actuated by a motored mechanism in the printer that moves a pick rack in the photo cassette to singulate a sheet into the main tray pick system. A sensor detects the advanced sheet and triggers the main tray pick mechanism to load the photo media sheet into the print zone. Users can print 4×6 inch photos without unloading plain paper or other media from the main input tray. Finally, by being removable, the photo cassette allows the mobile printer to remain portable. The photo cassette is removable and can be used to store the media when the photo cassette is not coupled to the printer. The photo cassette is easily stored with media inside to protect the media from extreme environment swings that may affect its shape.

Figure 1:
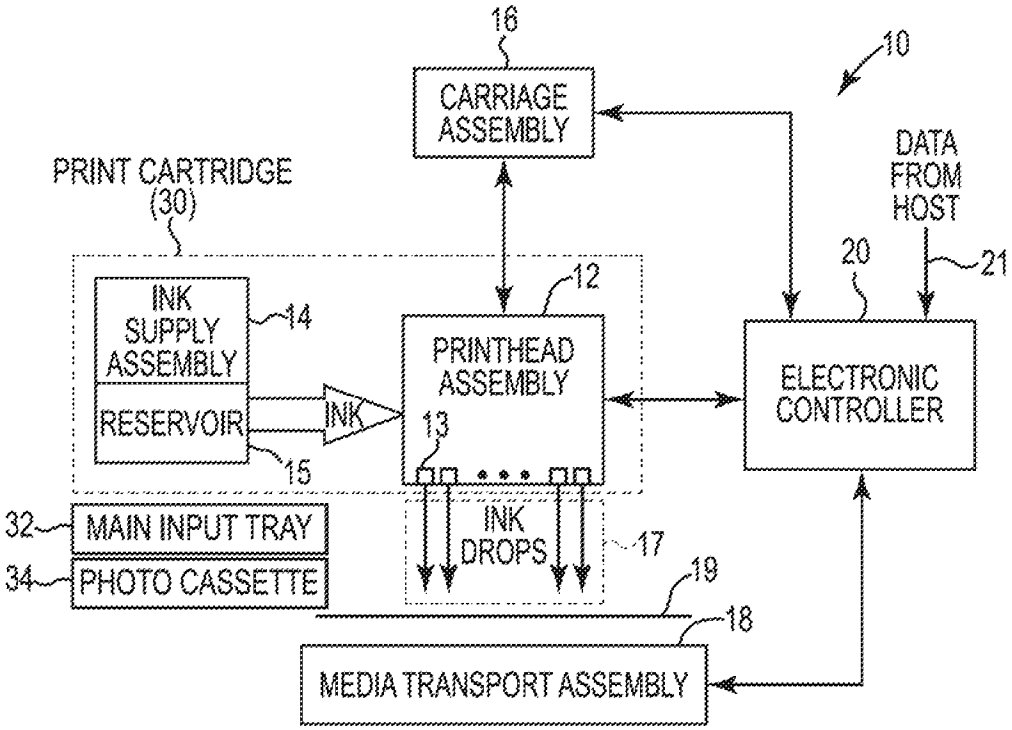
FIG. 1 is a block diagram illustrating an inkjet printing system according to one example.

FIG. 1 is a block diagram illustrating an inkjet printing system 10 according to one example. Inkjet printing system 10 includes a fluid ejection assembly, such as printhead assembly 12, and a fluid supply assembly, such as ink supply assembly 14. In the illustrated example, inkjet printing system 10 also includes a carriage assembly 16, a media transport assembly 18, and an electronic controller 20.

Printhead assembly 12 includes at least one printhead or fluid ejection device which ejects drops of ink or fluid through a plurality of orifices or nozzles 13. In one example, the drops are directed toward a medium, such as print media 19, so as to print onto print media 19. Print media 19 includes any type of suitable sheet material, such as paper, photo media, card stock, transparencies, Mylar, fabric, and the like. Prior to printing, print media 19 is stored in main input tray 32 and/or photo cassette 34. In one example, main input tray 32 stores regular paper media, and photo cassette 34 stores photo media for photo printing. Nozzles 13 are arranged in columns or arrays such that properly sequenced ejection of ink from nozzles 13 causes characters, symbols, and/or other graphics or images to be printed upon print media 19 as printhead assembly 12 and print media 19 are moved relative to each other.

Ink supply assembly 14 supplies ink to printhead assembly 12 and includes a reservoir 15 for storing ink. As such, in one example, ink flows from reservoir 15 to printhead assembly 12. In one example, printhead assembly 12 and ink supply assembly 14 are housed together in an inkjet or fluid-jet print cartridge or pen, as identified by dashed line 30. In another example, ink supply assembly 14 is separate from printhead assembly 12 and supplies ink to printhead assembly 12 through an interface connection, such as a supply tube.

Carriage assembly 16 positions printhead assembly 12 relative to media transport assembly 18, and media transport assembly 18 positions print media 19 relative to printhead assembly 12. Thus, a print zone 17 is defined adjacent to nozzles 13 in an area between printhead assembly 12 and print media 19. In one example, printhead assembly 12 is a scanning type printhead assembly such that carriage assembly 16 moves printhead assembly 12 relative to media transport assembly 18. In another example, printhead assembly 12 is a non-scanning type printhead assembly such that carriage assembly 16 fixes printhead assembly 12 at a prescribed position relative to media transport assembly 18.

Electronic controller 20 communicates with printhead assembly 12, carriage assembly 16, and media transport assembly 18. Thus, in one example, when printhead assembly 12 is mounted in carriage assembly 16, electronic controller 20 and printhead assembly 12 communicate via carriage assembly 16.

Electronic controller 20 receives data 21 from a host system, such as a computer, and may include memory for temporarily storing data 21. Data 21 may be sent to inkjet printing system 10 along an electronic, infrared, optical or other information transfer path. Data 21 represents, for example, a document and/or file to be printed. As such, data 21 forms a print job for inkjet printing system 10 and includes at least one print job command and/or command parameter.

In one example, electronic controller 20 provides control of printhead assembly 12 including timing control for ejection of ink drops from nozzles 13. As such, electronic controller 20 defines a pattern of ejected ink drops which form characters, symbols, and/or other graphics or images on print media 19. Timing control and, therefore, the pattern of ejected ink drops, is determined by the print job commands and/or command parameters. In one example, logic and drive circuitry forming a portion of electronic controller 20 is located on printhead assembly 12. In another example, logic and drive circuitry forming a portion of electronic controller 20 is located off printhead assembly 12.

Figure 2:
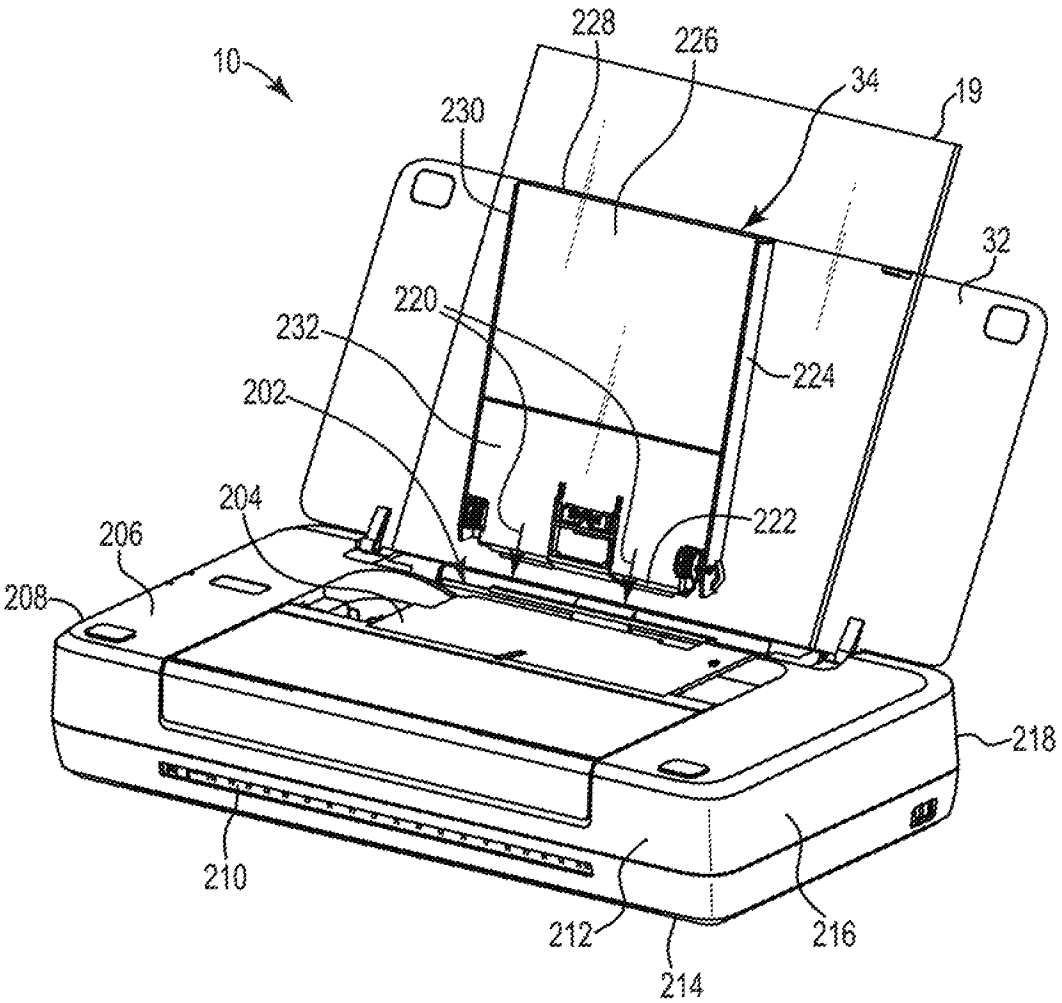
FIG. 2 is a diagram illustrating a perspective view of the printing system shown in FIG. 1 according to one example.

FIG. 2 is a diagram illustrating a perspective view of the printing system 10 shown in FIG. 1 according to one example. Printer 10 includes a top cover 32 that can be lifted up to function as the main input tray 32 to support print media 19 as shown in FIG. 2. Printer 10 includes a chassis 204 that supports the operative components of printer 10. Chassis 204 represents generally those parts of the printer housing along with other structurally stable elements in printer 10 that support the operative components of printer 10. In one example, printer 10 is a top-in, front-out printer, with print media being loaded vertically in and fed through the print zone 17 (FIG. 1) prior to being output through a front side of the printer 10.

Printer 10 has left side 208, right side 216, rear side 218, front side 212, top surface 206, and bottom surface 214. The top surface 206 is exposed when the top cover 32 is lifted up, as shown in FIG. 2. The top cover/main input tray 32 is positioned to feed print media 19 through the top surface 206 of the printer 10. The top surface 206 also includes a photo cassette insertion slot 202 formed therein for insertion of photo cassette 34. FIG. 2 shows the photo cassette 34 completely removed from the slot 202 of the printer 10. Arrows 220 are shown in FIG. 2 to represent the insertion of photo cassette 34 into the slot 202. The slot 202 is positioned in front of the main input tray 32, such that the slot 202 is closer to the front side 212 of the printer 10 than the main input tray 32. A media output 210 is formed in the front side 212 of the printer 10, which ejects print media 19 from the printer 10 after printing. The rear side 218 of the printer 10 is provided with a mechanism for receiving a power input, and a mechanism for receiving a data input from a computer or the like that transmits print data.

The photo cassette 34 is of a generally rectangular construction and has a top end 228, a bottom end 222, side walls 224 and 230, a support surface 226 for supporting photo media, and a top cover 232. The photo cassette 34 is sized so as to receive a standard photo media size, such as ten 4×6 inch photo media sheets. In one example, the photo cassette 34 is about 5 inches wide, about 6.5 inches in length, and about 0.75 inches in height. Photo cassette 34 is rugged and durable and is able to pass an 18 inch bare air drop test to a concrete surface. In one example, the printer 10 is about 14 inches across (i.e., from left side 208 to right side 216), about 7 inches from front side 212 to rear side 218, and about 2.5 inches in height. The printer 10 in one implementation has a weight of less than about 5 pounds.

Figure 3:
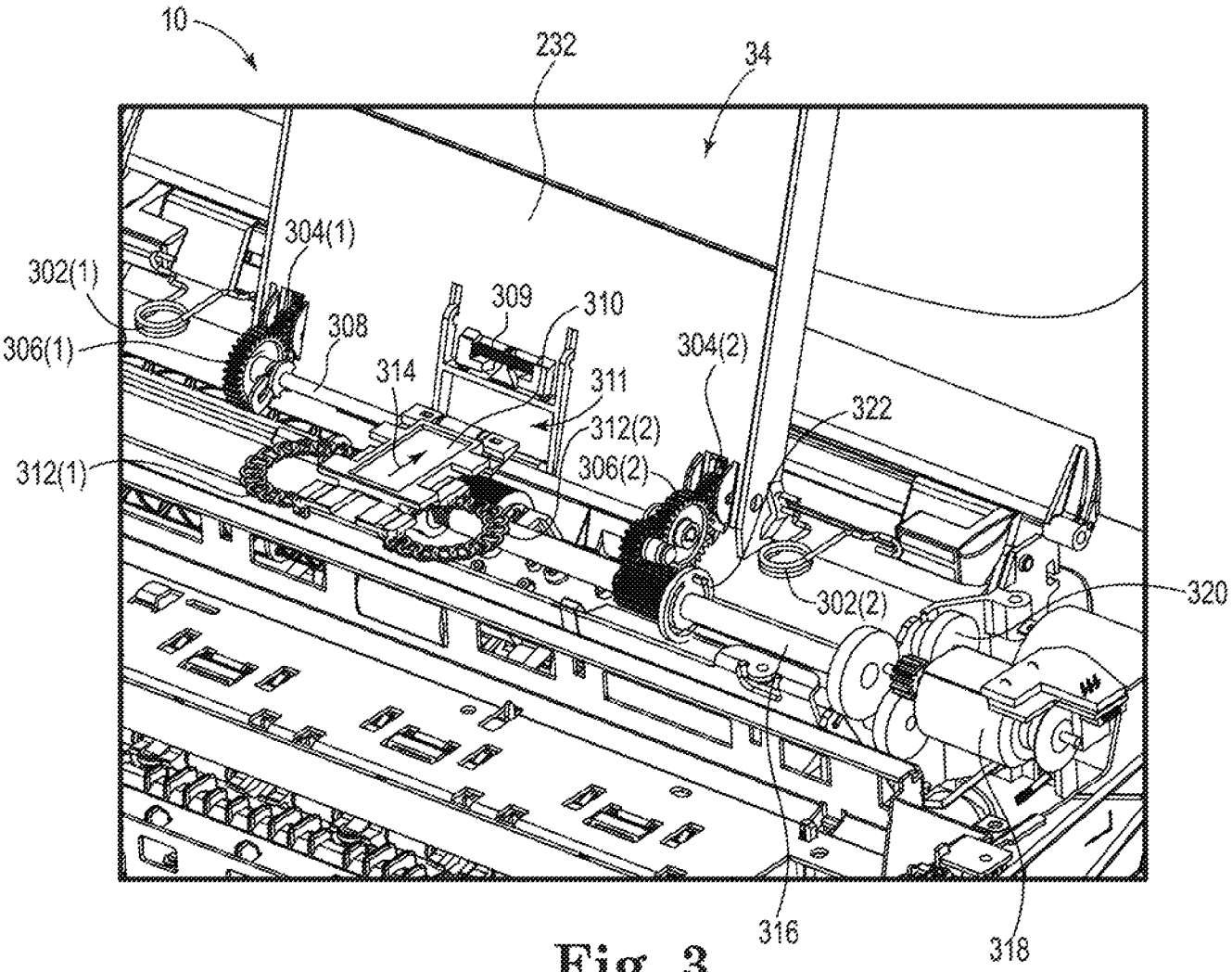
FIG. 3 is a diagram illustrating a perspective view of elements of the printing system shown in FIG. 2 with portions of the chassis and top surface removed according to one example.
Figure 4:
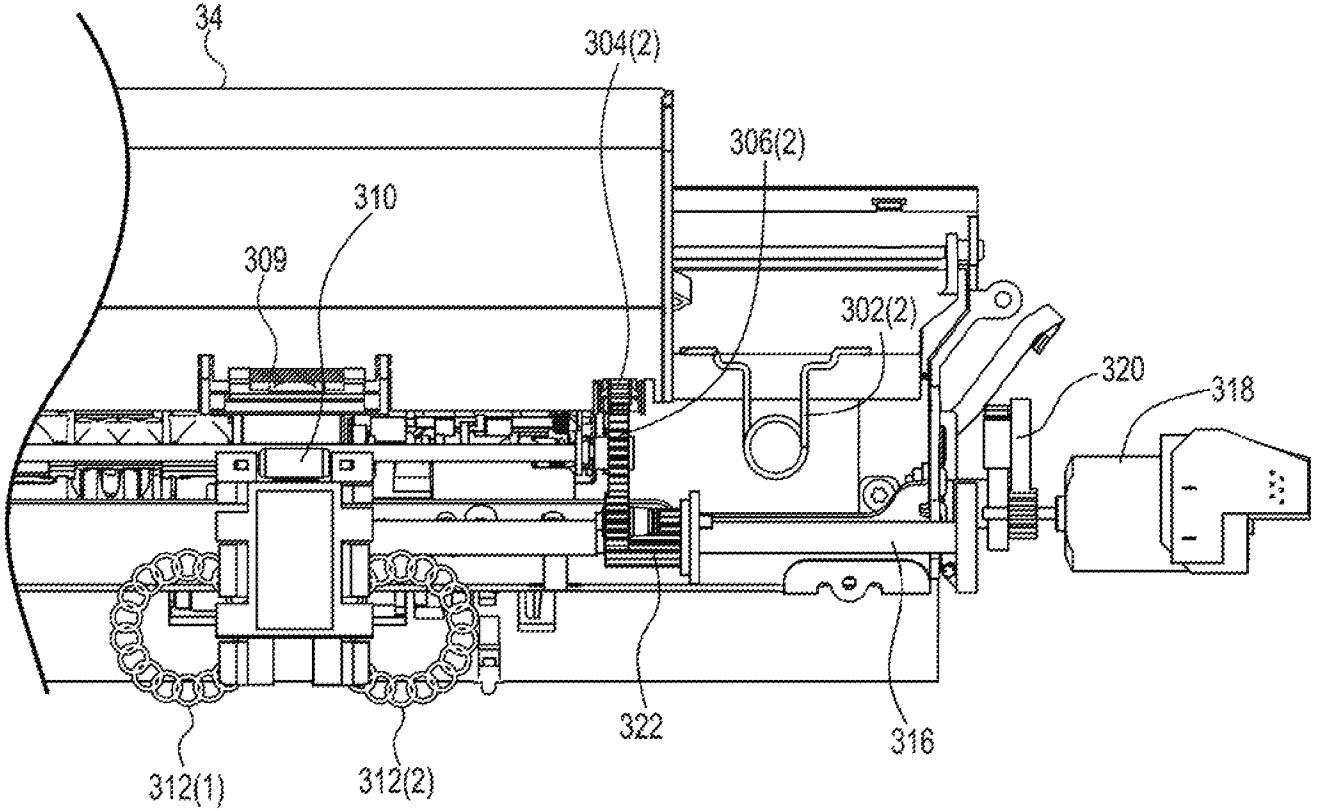
FIG. 4 is a diagram illustrating a top view of elements of the printing system shown in FIG. 2 with portions of the chassis and top surface removed according to one example.

FIG. 3 is a diagram illustrating a perspective view of elements of the printing system 10 shown in FIG. 2 with portions of the chassis 204 and top surface 206 removed according to one example. FIG. 4 is diagram illustrating a top view of elements of the printing system 10 shown in FIG. 2 with portions of the chassis 204 and top surface 206 removed according to one example. As shown in FIGS. 3 and 4, photo cassette 34 includes power take-off (PTO) gears 304(1) and 304(2), and separation spring 309. Printer 10 includes latch springs 302(1) and 302(2), PTO gears 306(1) and 306(2) coupled together by shaft 308, pinch guide and roller mechanism 310, over-center springs 312(1) and 312(2), shaft 316, motor 318, gear reduction mechanism 320, and loss motion timing mechanism 322.

Latch springs 302(1) and 302(2) are attached to printer 10 and latch photo cassette 34 to the printer 10 when the photo cassette 34 is inserted into the insertion slot 202 (FIG. 2). In operation, the pinch guide and roller mechanism 310 is moved inward toward photo cassette 34, as indicated by arrow 314, through a rectangular opening or window 311 formed in the cover 232 of the cassette 34, and provides normal force to the stack of photo media in the photo cassette 34 to facilitate advancement of a photo media sheet from the cassette 34. The motor 318 drives the shaft 316, which causes rotation of the PTO gears 306(1) and 306(2). PTO gears 306(1) and 306(2) are engaged with PTO gears 304(1) and 304(2), respectively, of the photo cassette 34, and the rotation of the PTO gears 306(1) and 306(2) causes rotation of the PTO gears 304(1) and 304(2), which causes movement of a pick rack mechanism in the photo cassette 34. The loss motion timing mechanism 322 is used to accurately move the pinch guide 310 to pinch the photo media prior to moving the pick rack mechanism to advance the photo media. In one example, motor 318 is dedicated to the photo cassette 34, and a second, separate motor (not shown) is provided to drive print media from the main input tray 32.

Figure 5:
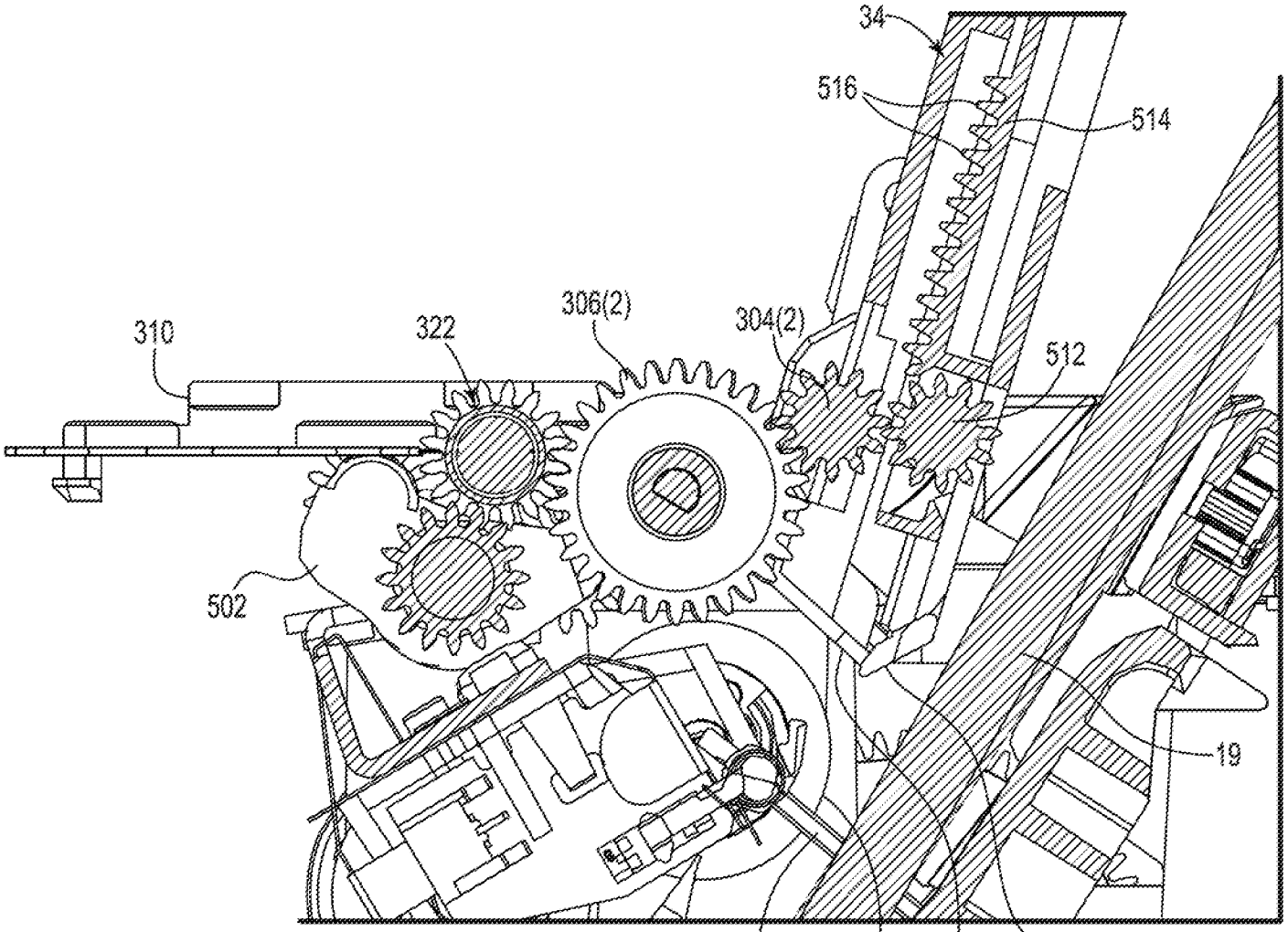
FIG. 5 is a figure illustrating a cross-sectional view of a portion of the printing system shown in FIG. 2 according to one example.

FIG. 5 is a figure illustrating a cross-sectional view of a portion of the printing system 10 shown in FIG. 2 according to one example. As shown in FIG. 5, printer 10 includes PTO gear 306(2), pinch guide and roller mechanism 310, pinch activation swing arm 502, media presence sensor 504, and pick tire 506. Photo cassette 34 includes PTO gear 304(2), separation assembly 508, separation gate 510, gear 512, and pick rack 514. Photo cassette 34 also includes a second gear 512 that is not shown in FIG. 5 that engages with PTO gear 304(1).

In operation, the pinch guide and roller mechanism 310 is moved toward photo cassette 34 and provides normal force to the stack of photo media in the photo cassette 34 to facilitate advancement of a photo media sheet from the cassette 34. The rotation of PTO gear 306(2) causes rotation of the PTO gear 304(2), and the rotation of PTO gear 306(1) (FIG. 3) causes the rotation of the PTO gear 304(1) (FIG. 3), which causes movement of pick rack 514 and advancement of a photo media sheet from the photo cassette 34, with the photo media sheet exiting the cassette 34 between the separation assembly 508 and the separation gate 510. Gear 512 is coupled to and moves with pick rack 514. Pick rack 514 includes teeth 516. PTO gear 304(2) engages with the gear 512 and the teeth 516 of the pick rack 514, and PTO gear 304(1) (FIG. 3) engages with the second gear 512 (not shown) and the teeth of the pick rack 514, to cause movement of the pick rack 514.

Media presence sensor 504 detects when the leading edge of a media sheet has been advanced to be adjacent to the pick tire 506. The pick tire 506 according to one example is the main pick system for the printer 10, and picks and advances sheets of print medium 19 from the main input tray 32. When cassette 34 is installed in printer 10, the pick tire 506 is also responsible for advancing sheets of photo media from the cassette 34. When the media presence sensor 504 detects the leading edge of a media sheet, the sensor 504 signals the printer 10 to initiate a regular pick cycle, which causes the pick tire 506 to advance the media sheet along the media path toward the print zone 17 (FIG. 1). Gears 512 allow the pick rack 514 to be moved in one direction to the end of its allowable movement without having to stall the motor 318 (FIG. 3) when the end of the allowable movement of the pick rack 514 is reached. At this point, the motor 318 will continue to drive the gears 304(1) and 304(2), but no further movement of the pick rack 514 in that direction occurs.

Figure 6B:
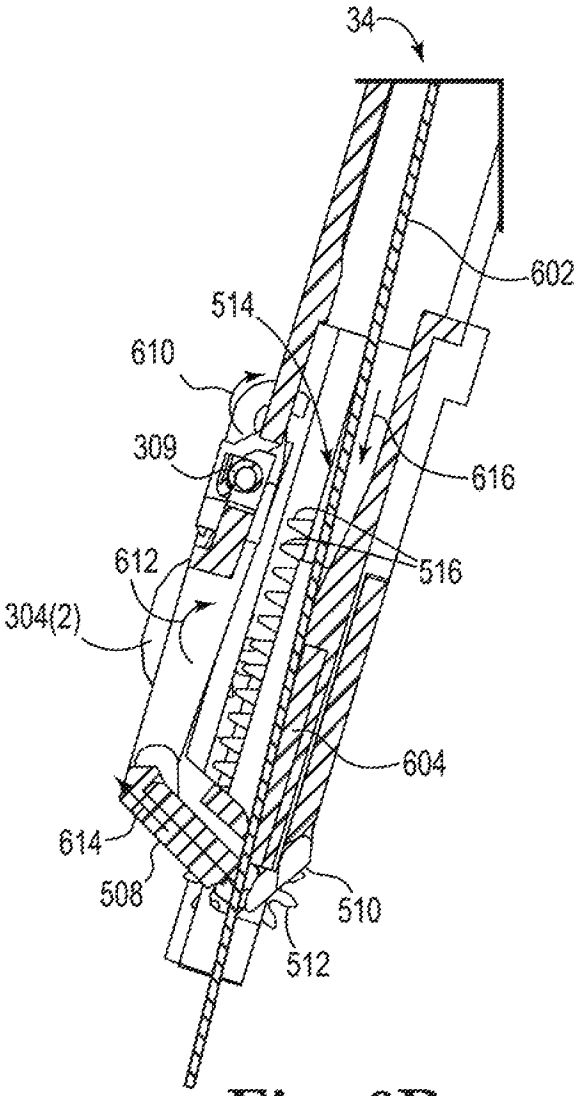
FIG. 6B is a diagram illustrating a side cross-sectional view of a photo cassette with a pick rack in an advanced position according to one example.
Figure 6A:
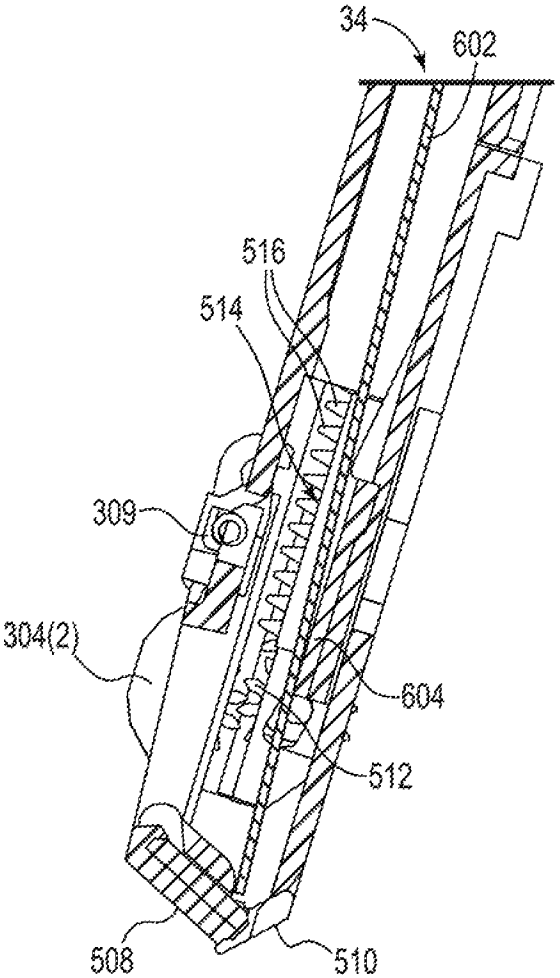
FIG. 6A is a diagram illustrating a side cross-sectional view of a photo cassette with a pick rack in a starting position according to one example.

FIG. 6A is a diagram illustrating a side cross-sectional view of photo cassette 34 with the pick rack 514 in a starting position according to one example. The pick rack 514 includes an elastomer pick pad 604. The pick rack 514, the pick pad 604, and the gears 512 are coupled together and move together to cause a single sheet of photo media to be picked from the bottom of a stack of photo media sheets and advanced from the photo cassette 34. As shown in FIG. 6A, pick pad 604 makes contact with a photo media sheet 602, and maintains frictional contact with the sheet 602 during movement of the pick rack 514 and pick pad 604 to cause a corresponding movement of the photo media sheet 602.

FIG. 6B is a diagram illustrating a side cross-sectional view of photo cassette 34 with the pick rack 514 in an advanced position according to one example. The rotation of PTO gear 306(2) (FIG. 3) in the printer 10 causes rotation of the PTO gear 304(2) in the photo cassette 34, as represented by arrow 612, and the rotation of PTO gear 306(1) (FIG. 3) in the printer 10 causes rotation of the PTO gear 304(1) in the photo cassette. These gear motions causes movement of pick rack 514 and pick pad 604 in the direction indicated by arrow 616, which advances the photo media sheet 602 in the same direction. PTO gears 304(1) and 304(2) engage with the gears 512 and the teeth 516 of the pick rack 514 to cause movement of the pick rack 514, the pick pad 604, and the gears 512. The pick pad 604 maintains frictional contact with the photo media sheet 602 during movement of the pick pad 604, which causes a corresponding movement of the photo media sheet 602. When the leading edge of the photo media sheet 602 reaches the separation assembly 508, the separation assembly 508 moves slightly upward as indicated by arrow 614 by the force balance of the sheet 602 pushing on it, and the separation gate 510 moves to an open position as shown in FIG. 6B to allow the photo media sheet 602 to be advanced outside of the photo cassette 34. Elastomer friction maintains the remainder of the stack of photo media sheets in the photo cassette 34 while the single sheet 602 is advanced out of the cassette 34. The use of a pick rack 514 and pick pad 604 as shown in FIGS. 6A and 6B allows the photo cassette 34 to have a slimmer design than a design that uses an elastomer tire as a pick mechanism.

Separation spring 309 is a tightly wound coil spring acting as a beam in bending that provides a retarding force for the separation assembly 508 to singulate a page from the stack being moved by the pick rack 514. Arrow 610 represents the rotation around the pivot of the separation assembly 508 due to photo media pushing on it.

One example is directed to a photo cassette for a mobile printer. The photo cassette includes a support surface to support a stack of photo media sheets; a cover to at least partially cover the stack of photo media sheets; and a window formed in the cover to receive a pinch mechanism of the mobile printer through the window to provide a normal force to the stack of photo media sheets.

The movable pick rack may include an elastomer pick pad to pick and advance one of the photo media sheets at a time from the photo cassette. The elastomer pick pad may move underneath the stack of photo media sheets to pick and advance the photo media sheets from a bottom of the stack.

The photo cassette may include at least one gear to drive movement of the pick rack. The pick rack may include a plurality of teeth that engage with the at least one gear to cause movement of the pick rack. The photo cassette may include at least one second gear attached to and movable with the pick rack. The at least one second gear may facilitate movement of the pick rack to an end of an allowable movement of the pick rack without stalling a motor that drives the movement of the pick rack. The at least one gear of the photo cassette may be driven by at least one gear of the mobile printer. The pick rack may advance one of the photo media sheets at a time from the photo cassette to a pick assembly for a main input tray of the mobile printer. The photo cassette may be sized to hold 4×6 inch photo media sheets.

Another example is directed to a mobile printing system that includes a main input tray, a print engine, a main pick mechanism to move standard media sheets from the main input tray toward the print engine along a media path, and a removable photo cassette including a movable pick rack to move photo media sheets from the photo cassette to the main pick mechanism for further movement of the photo media sheets toward the print engine along the media path. The mobile printing system also includes a printer controller to control operation of the print engine, the main pick mechanism, and the pick rack.

The mobile printing system may comprise a top-in, front-out mobile printer that weighs less than about 5 pounds, and the photo cassette may be insertable into a slot in a top surface of the printer in front of the main input tray. The mobile printing system may also include at least one cassette gear in the photo cassette to cause movement of the pick rack; at least one printer gear to cause movement of the at least one cassette gear; and a printer motor to drive the at least one printer gear.

Yet another example is directed to a method that includes advancing a photo media sheet from a photo cassette in a mobile printer using a movable pick rack in the photo cassette, wherein the photo media sheet is advanced by the pick rack to a main pick mechanism of the mobile printer that advances standard media sheets from a main input tray of the mobile printer. The method also includes advancing the photo media sheet with the main pick mechanism toward a print engine of the mobile printer for printing on the photo media sheet.

In one form of this example, the photo media sheet may be initially contained in a stack of photo media sheets in the photo cassette, and the method may further include inserting a pinch mechanism of the mobile printer through a window of the photo cassette to provide a normal force to the stack of photo media sheets during advancement of the photo media sheet by the pick rack.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A photo cassette for a mobile printer, comprising:

a support surface to support a stack of photo media sheets;

a cover to at least partially cover the stack of photo media sheets;

a window formed in the cover to receive a pinch mechanism of the mobile printer through the window to provide a normal force to the stack of photo media sheets;

a movable pick rack including teeth on a first side to interact with a power take-off (PTO) gear; and an elastomer pick pad coupled to a second side of the movable pick rack to pick and advance one of the photo media sheets at a time from the photo cassette.

2. The photo cassette of claim 1, wherein the elastomer pick pad moves underneath the stack of photo media sheets to pick and advance the photo media sheets from a bottom of the stack.

3. The photo cassette of claim 1, and further comprising:

an internal gear attached to and movable with the pick rack.

4. The photo cassette of claim 3, wherein the internal gear facilitates movement of the pick rack to an end of an allowable movement of the pick rack without stalling a motor that drives the movement of the pick rack.

5. The photo cassette of claim 1, wherein the PTO gear of the photo cassette is driven by a gear of the mobile printer.

6. The photo cassette of claim 1, wherein the pick rack advances one of the photo media sheets at a time from the photo cassette to a pick assembly for a main input tray of the mobile printer.

7. The photo cassette of claim 1, wherein the photo cassette is sized to hold 4×6 inch photo media sheets.

8. A mobile printing system, comprising:

a main input tray;

a print engine;

a main pick mechanism to move standard media sheets from the main input tray toward the print engine along a media path;

a removable photo cassette including a movable pick rack that includes a plurality of teeth on a first side and an elastomer pick pad on a second side to move photo media sheets from the photo cassette to the main pick mechanism for further movement of the photo media sheets toward the print engine along the media path;

a printer controller to control operation of the print engine, the main pick mechanism, and the pick rack; and a cassette gear, coupled to the movable pick rack, in the photo cassette to cause movement of the pick rack through an interaction between the cassette gear, the plurality of teeth of the pick rack, and a power take-off gear.

9. The mobile printing system of claim 8, wherein the mobile printing system comprises a top-in, front-out mobile printer that weighs less than about 5 pounds, and wherein the photo cassette is insertable into a slot in a top surface of the printer in front of the main input tray.

* * * * *